US009969407B2

(12) United States Patent
Pirli

(10) Patent No.: US 9,969,407 B2
(45) Date of Patent: May 15, 2018

(54) HIGH SPEED TRANSPORTATION VEHICLE-CAPSULE ISOLATED FROM EXTERNAL INFLUENCES

(71) Applicant: Aslan Ali Pirli, Gebze (TR)

(72) Inventor: Aslan Ali Pirli, Gebze (TR)

( * ) Notice: Subject to any disclaimer, the term of this patent is extended or adjusted under 35 U.S.C. 154(b) by 30 days.

(21) Appl. No.: 15/110,474

(22) PCT Filed: Jan. 8, 2015

(86) PCT No.: PCT/TR2015/000013
§ 371 (c)(1),
(2) Date: Jul. 8, 2016

(87) PCT Pub. No.: WO2015/105471
PCT Pub. Date: Jul. 16, 2015

(65) Prior Publication Data

US 2016/0325759 A1 Nov. 10, 2016

(30) Foreign Application Priority Data

Jan. 10, 2014 (TR) ..... 201400293

(51) Int. Cl.
*B61B 1/00* (2006.01)
*B61B 1/02* (2006.01)
*B61B 13/10* (2006.01)

(52) U.S. Cl.
CPC ..... *B61B 1/02* (2013.01); *B61B 13/10* (2013.01)

(58) Field of Classification Search
CPC B61B 1/02; B61B 13/10; B61B 13/12; B61B 13/122; B61B 13/125; B61B 13/127
See application file for complete search history.

(56) References Cited

U.S. PATENT DOCUMENTS 4,023,500 A * 5/1977 Diggs ..... B61B 13/10 104/138.1
4,184,792 A * 1/1980 Turnbo ..... B61B 13/10 406/110
4,881,469 A * 11/1989 Hirtz ..... B61B 13/10 104/138.1
5,537,929 A * 7/1996 Miura ..... B23Q 1/40 104/138.1
6,279,485 B1 * 8/2001 Schlienger ..... B60V 3/04 104/138.1

(Continued)

FOREIGN PATENT DOCUMENTS

KR 20120066235 A 6/2012

OTHER PUBLICATIONS

International Search Report, Application No. PCT/TR2015/000013, dated Apr. 20, 2015, 2 pages.

*Primary Examiner* — Jason C Smith
(74) *Attorney, Agent, or Firm* — Ziegler IP Law Group, LLC

(57) ABSTRACT

The present invention relates to a high speed transportation vehicle with a convenient diameter which is installed between two stations which has the ability of providing high take-off by reserve depots and providing control of the platform line by means of satellite and sensors, having portable cabins (16) providing drop off and pick up passengers in seconds and reverting the air from front to the back of the capsule moving in a cylinder (1) and purifying the capsule (10) from the external influences without any resistance.

12 Claims, 21 Drawing Sheets

(56) References Cited

U.S. PATENT DOCUMENTS

Figure 1:
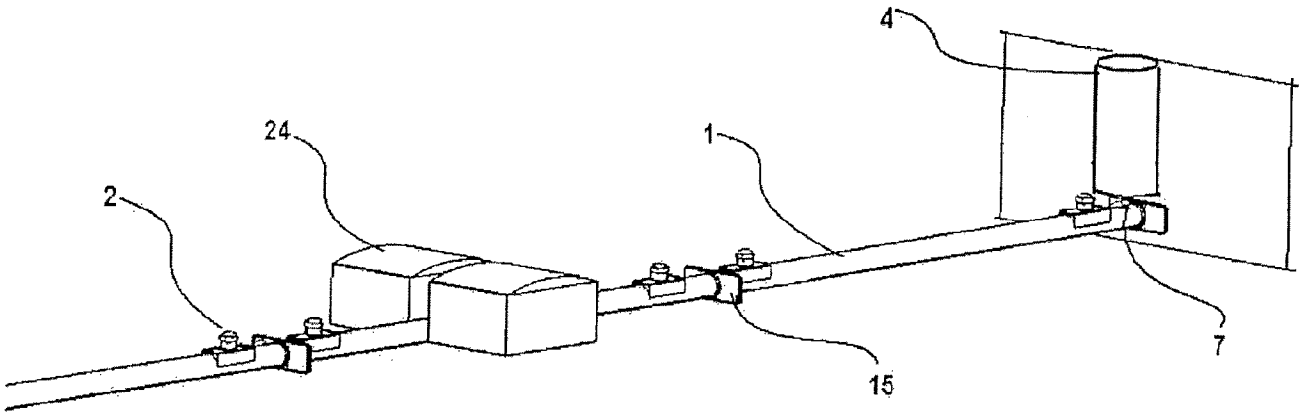

| | | | | |
|---|---|---|---|---|
| 8,584,593 | B2 * | 11/2013 | Friedmann | B60L 13/04 104/138.1 |
| 2009/0101040 | A1 * | 4/2009 | Yang | B61B 13/10 104/138.1 |
| 2010/0083864 | A1 * | 4/2010 | Flynn | B61B 13/10 104/138.1 |
| 2010/0192799 | A1 * | 8/2010 | Miller | B60L 13/04 104/138.1 |
| 2011/0259236 | A1 * | 10/2011 | Kwon | B60L 13/03 104/138.1 |
| 2014/0000473 | A1 * | 1/2014 | Miller | B61C 11/06 104/138.1 |
| 2014/0261054 | A1 * | 9/2014 | Oster | E01B 25/34 104/130.02 |
| 2014/0261055 | A1 * | 9/2014 | Oster | B61B 13/10 104/138.1 |
| 2016/0229427 | A1 * | 8/2016 | Avetian | B61B 13/10 |
| 2016/0230350 | A1 * | 8/2016 | Bambrogan | B61B 13/10 |
| 2016/0230915 | A1 * | 8/2016 | Cothern | F16L 51/00 |
| 2016/0325759 | A1 * | 11/2016 | Pirli | B61B 13/10 |
| 2017/0106879 | A1 * | 4/2017 | Coutre | B61B 13/10 |
| 2017/0197639 | A1 * | 7/2017 | Miller | B61B 13/10 |

* cited by examiner

HIGH SPEED TRANSPORTATION VEHICLE-CAPSULE ISOLATED FROM EXTERNAL INFLUENCES

The present invention relates to a high speed transportation vehicle isolated from external influences which provides braking and high take-off by reserve depots that are positioned on the both ends of the cylinder line with a convenient diameter which is installed between two stations and providing control of the platform line by means of satellite and sensors and has portable cabins providing drop off and pick up passengers in seconds, and revert the air from front to the back of the capsule moving in a cylinder, purifying the capsule from the external influences without any resistance.

The present invention as high speed transportation vehicle isolated from external influences includes; cylinder (1), electro mechanism equipped cylinder fixing clamp (19), transportation capsule (10), rail cage system (18), Propeller DC motor (11), DC motor propeller (22), air bag (12), high pressure air reserve depot (4), alternative air transfer motors (2), sliding door with multiple sensors (15). Thanks to isolating the transportation capsule (10) from external influences provides decreasing the pressure in front of capsule and thus increasing the pressure on the back of capsule hereby this provides high speed movement to the capsule with very low energy.

Cylinder (1) line installed between the distance of terminus and arrival station. High pressure air reserve depots (4) are positioned on the stations which situated on the both ends of line. A multiple of alternative air transfer motors (2) and sliding door with multiple sensors (15) are mounted to the cylinder (1) through line from outside in connection with line length. Transportation capsule (10) inserted to the cylinder (1) provides transportation of vehicle from one station to another by means of pressure difference arised from transfer of air from the front of transportation capsule (10) to the back and outside of it. In the first take off, transportation capsule (10) reaches a high speed in a short span of time by means of support of high pressure air reserve depot (4). Alternative air transfer motors (2) that are mounted from the outside are fixed to the cylinder (1) with appropriate ranges set through line. While one of the alternative air transfer motors (2) pumps air to the inside of cylinder (1) another one automatically provides air transfer inside from cylinder (1) to the outside. While air presents of transportation capsule (10) perpetually evacuated and air pumped to its back side perpetually at the same time DC motor propeller (22) from the inside transmits the air presented on the front side of transportation capsule (10) to the back side of transportation capsule (10) and thus provides high speed movement to the transportation capsule (10) through the line without any resistance. Before it reaches to its station of destination, air presented in the distance between the transportation capsule (10) and its station of destination is blocked and compressed by transportation capsule (10) and then it is stored as compressed to the inside of high pressure air reserve depot (4) in the station of destination. In this way energy which consumed in the beginning is recovered while this energy performing the braking effect. Thanks to automatically systems in the station of transportation capsule (10) that reached to the station, reached to the station and standing sequential and portable passenger and cargo carrying cabins (16) positioned inside of the rail cage system (18) and cabin chamber (31) which are positioned inside of the transportation capsule (10) are discharged and embarked in seconds. Also rail cage system (18) which presented inside the transportation capsule (10) has damper equipments (17) on the each head part.

Cylinder (1) that moves inside of the transportation capsule (10) provide decreasing of the effects that force the movement of transportation capsule (10) while in transportation progress and isolating it from the external influences. In this situation, passenger and cargo carrying cabins (16) on the transportation capsule (10) within cylinder (1) that mounted between the terminus and station of destination are designed regarding to passenger or cargo in the station to provide shorten the time of discharge and embarking of the passengers and cargo. While passenger and cargo carrying cabins (16) having passenger and cargo inside them that will board to the transportation capsule(10) are placed to the transportation capsule (10) at the station, passenger and cargo carrying cabins (16) that will get out at the station are send away from the transportation capsule (10). Passenger and cargo carrying cabins (16) standing on the station that equipped with automatically systems are being transmitted to the transportation capsule (10) or they suspended from transportation capsule (10) in seconds.

Cylinder (1), supports the movement with pushing force support on pressured air in the front that dispatched by DC motor propeller (22) to the inside surface area and transportation capsule (10) transmits the air to the space that present behind of capsule that providing inhibition of vacuum effect on the back side and provides movement of capsule thanks to cap which inhibits the air passage (20) and air guiding throttles (21) that are positioned on the each side of transportation capsule (10). While propeller DC motor (11) within the inlet air duct (14) that positioned on the subpart of front surface of transportation capsule (10) transmitting the air inside to the current air bag (12) equipment, at the same time air transmitted to the outside and this provides decreasing of air pressure occurred on the front part of transportation capsule (10) thanks to the support of alternative air transfer motor (2). While the exhausting the air in front of transportation capsule (10) that equipped with sensor controlled automatically adjustable sealing gasket (13) for distances that positioned on both head part without any contact to inside perimeter of cylinder (1) and transportation capsule (10) pressure occurred on the back side. Thanks to automatically controlled valve motor open (7), heavy mass piston (5) inside the high pressure air reserve depot (4) that the inner surface made of with very slick (teflon, etc.) material moves downward and gives the movement to LO the transportation capsule (10). Inlet air duct (14) of propeller DC motor (11) for air bag that presented on capsule closed automatically controlled on stand by position in an empty area while braking effect starting, transportation capsule (10) and thus air passage inhibited and high pressure occurred. While the released transportation capsule (10) moves forward to the arrival station, cabin compartments (31) of the rail cage system (18) moving when it is necessary reduce the backwards shock effect of the passenger and cargo carrying cabins (16) with damper equipments (17), thus the passengers in the passenger and cargo carrying cabins (16) can tolerate the shock effect. Surface area of inner perimeter of cylinder (1) that the transportation capsule (10) moves inside is covered with very flat and slick (teflon, etc.) material and friction minimalised while sealing gasket (13) contacts inner surface of cylinder (1) time to time.

In order to provide support for perpetual acceleration of transportation capsule (10) inside of the cylinder (1), air standing in front of transportation capsule (10) evacuated to the outside with DC motor propeller (22) and alternative air transfer motor (2). Alternative air transfer motor (2) draws the air gradually in an automatic way through the way till reaching to the other station from the front of transportation capsule (10) and pushes it to the back side of transportation capsule (10) and stops after a while. This process is carried out respectively by all alternative air transfer motors (2) that installed through all line. Thanks to maintain this process in accordance with the aim automatically opening and closing of sliding door with multiple sensors (15) that presented on the place of alternative air transfer motor (2) through line the transportation capsule (10) reaches to the high speed. While it is approaching to the station of destination, air transfers are inhibited in front of the transportation capsule (10) inside of the cylinder (1) that placed on a designated distance regarding speed. Air transfer in the area between the sliding door with multiple sensors (15) and transportation capsule (10) of station of destination is blocked. With the starting of compression of air that blocked in front of the transportation capsule (10) coming with high speed to the station of destination, electromechanic equipped valve (6) presented in the front side of sliding door with multiple sensors (15) opens and thus it starts to compress the air inside to the high pressured air reserve depot (4) that presented on the destination of station. High pressured air that consumed on the departure station gained by reserved depot (4) as high pressure air reserve depot (4) on the arrival station.

Detailed Explanation of the Parts Included in the System:

Transportation Cylinder

Cylinder (1) installed between the distance of starting and arrival stations. Excavating of tunnel might be necessary because of structure of land in order to firmly install the line of cylinder (1). In some places it might be installed firmly to the floor. In some places cylinder (1) line can be installed by means of tower post or viaducts. The places that determined by GPS satellite positioning and different sensors, cylinder fixed by electromechanic equipped cylinder fixing clamp (19) in order to inhibit installed line of cylinder (1) from the effects of earthquake or other ground motions. Fixing automatically inhibits effects that might be come from the directions of up and down or left or right. Modification is not permitted for system without human will and line providing as flat all the time. Inner surface area of cylinder (1) is covered with a very flat and very slick (teflon etc.) material. If cylinder (1) line that installed in the plane of light, transportation capsule (10) might reaches to high speed with securely in proportion with flatness of line. Transportation capsule (10) that moving inside the cylinder (1) when multiple sensors doors that mounted on top end on both station encounters with any resistance and provide its movement from a station to another.

Cylinder Fixing Clamp

Electromechanism equipped cylinder fixing clamp (19) provides the cylinder (1) that installed through line fixed to the ground. Cylinder fixing clamp (19) commanded thanks to GPS satellite systems and sensors equipped with proper spaces. Alterations that may occur on the ground arising from the movements on the direction of up and down or left or right because of natural events as geologic etc. that might threat the transportation on the line of cylinder (1) are simultaneously regulated as fully automatic.

An eccentric medium adapter (34) rotatable with the angle of 360 degree and counteract the lateral geologic effects positioned under the cylinder fixing clamp (19) in order to absorb the extraordinary alterations that may occur on lateral and upward and downward land on the time of geologic phenomenons such as earthquake and landslide etc. and on the other hand abutment cylinder (36) and abutment plate piston (35) that moving inside of it absorbs geological effects as upward and downward movements.

Eccentric medium adapter (34) supports fully automatically absorbing of geological lateral effects by the support of GPS and sensors. Abutment plate piston (35) for geological perpendicular and vertical effects, full automatically keep fixed of cylinder (1) line on the desired position by the support of GPS and sensors.

Abutment cylinder (36) is stabilized deeply and strongly to the ground in such a way that it can rises to different heights according to land structure and supports the cylinder (1) line plane.

Alternative Air Transfer Motors

There are a lot of alternative air transfer motors (2) which are mounted along the line via outer side of the cylinder (1) installed line between the distance of terminus and arrival stations. While one of this air transfer motors pumps air into the cylinder (1) from the outside, the other air transfer motor discharges air out of the cylinder (1). The wings of the alternative air transfer motors (2) pumps air into the cylinder (1) just like airplane propellers also discharges air out of the cylinder (1). In other words, by closing and opening the alternative motor slide (32) and sliding door with multiple sensors (15) when it is necessary via changing the wing angles for both directions, it performs this process full automatically together with equipments like sensors etc. Thus, it promotes the movement of the capsule by providing reinforcement air support to the transportation capsule (10). When the transportation capsule (10) is precluded because of malfunctions occurred at available DC motors or any other reasons, discharging the air within the cylinders (1) front part of the transportation capsule (10) and enhancing the air pressure within the cylinders (1) back part of the transportation capsule (10) is provided by alternative air transfer motors (2). Thus, transportation capsule (10) moves and reaches to the next station.

High Pressure Air Reserve Depots

High pressure air reserve depots are present which are mounted at the both front sides of the cylinder (1) installed line at terminus and arrival stations. The inner surface area is covered with a very smooth and very slippery material (for example teflon etc.). Environment of the heavy mass piston (5) found in the high pressure air reserve depot (4) is equipped with slippery gaskets, sealing and friction is minimalized. With the intention of supporting the transportation capsule (10) which moves in high speed within the cylinder (1) to be able to stop at the desired station, heavy mass piston (5) found in high pressure air reserve depot (4) pushes the blocked air upwards instead of break and compresses it and gains high pressure air and enables the transportation capsule (10) to stop in a secure way. Sliding door with multiple sensors (15) opens and transportation capsule (10) moves to the next stage. Transportation capsule (10) then stands by to use the air reserve it gains in order to go to another station, in this way it gains back the spent energy. These processes are repeated in every station along the line.

Transportation Capsule

Transportation capsule (10) minimalizes the contact of the front side to the cylinder (1) and sealing gasket (13) having an adjustable sensor controlled mechanism, provides the sealing automatically. In order to lower the high temperature which can occur in the sealing gasket (13) because of the speed during the friction and in order to cool the gasket, there are channels that can maintain refrigerating gas circulation. Portably inserted cabin compartment (31) within the rail cage system (18) at the transportation capsule (10) performs the transport of the passenger and cargo via passenger and cargo carrying cabins (16). These cabins are designed differently for passengers and cargos. Transportation capsules (10) rail cage system (18) has damper equipments (17) which absorb the shock effect at both front sides. Damper equipments (17) inhibit the shock effect that will occur at the load depending on the take-off speed. When it gets close to. the arrival station, damper equipments (17) transmit sudden breaking effects by the automatically controlled system to the transportation capsules (10) rail cage system (18). Cabin transfer systems (23) at the station enables the discharge and embarking by scale of seconds respectively cabin compartment (31) inserted cabins passenger and cargo carrying cabins (16) into rail cage system (18) of the transportation capsule (10).

Propeller DC motor (11) which is present at the front bottom side at the transportation capsule (10) transmits the air in front of the transportation capsule (10) into the air bag (12) and minimalise the friction of the transportation capsule (10) to the cylinders (1) inner surface. Air channels present in both front side parts of the transportation capsule (10) transmits the pressured air in a controlled way via the cap which inhibits the air passage during take-off (20), air guiding throttle (21) and DC motored propellers (22) and gets support from the friction of the pressured air to the cylinders (1) inner surface, enables the movement of the transportation capsule (10). At the same time, air guiding throttle (21) guides the air in such a way that pressured air is minimally frictioned to the outer surface of the transportation capsule (10) body and dispatches the air to the field blanking at the inner surface of the cylinder (1) at the back of the transportation capsule (10). Thus, the movement of transportation capsule (10) is maintained in an efficient way. Besides, when the air inside the high pressure air reserve depot (4) during the first take-off at the station is released in order to support the transportation capsules (10) first movement during take-off, the cap which inhibits the air passage during take-off (20) closes the air channel entirely in order to inhibit the pressure passing to front side of the transportation capsule (10). Thus, by obtaining negative (–) air pressure at the front area of the transportation capsule (10) and positive (+) air pressure at the back area of the transportation capsule (10), the productive movement of the transportation capsule (10) is maintained with very little friction and without facing any resistance by little energy.

Air Guiding Throttles

Cylinder (1) with the capsule (10) on the inner part, air pass channels (9) found at the both sides of the capsule (10) and the cap (20) stopping the air pass channels (9) at the first take-off which inhibits the air passage during take-off, dispatches the pressured air transmitted by air guiding throttle (21) and DC motored propellers (22) to the cylinders (1) inner surface. The pressured air provides the movement of the transportation capsule (10) by getting support from the cylinders (1) inner surface. At the same time, air guiding throttle (21) guides the air in such a way that pressured air is minimally frictioned to the outer surface of the transportation capsule (10) body and dispatches the air to the field blanking at the inner surface of the cylinder (1) at the back of the transportation capsule (10). Thus, the movement of transportation capsule (10) is maintained in an efficient way. Besides, when the air inside the high pressure air reserve depot (4) during the first take-off at the station is released in order to support the transportation capsules (10) first movement during take-off, the cap which inhibits the air passage during take-off (20) closes the air channel entirely in order to inhibit the pressure passing to front side of the transportation capsule (10). By inhibiting the air passing to front side of the transportation capsule (10), the transportation capsule (10) starts to move. After a while during the transportation capsule (10) moves on, the back pressure starts to fall and cap which inhibits the air passage during take-off kapak (20) which dispatches by DC motored propellers (22) opens and guides the pressured air to the back of the transportation capsule (10) and transportation capsule (10) moves at desired speed.

Sliding Door with Multiple Sensors

Sliding door with multiple sensors (15) are positioned between the terminus points of the stations and alternative air transfer motors (2) mounted enormously along the line via outer side of the cylinder (1) installed line between the distance of terminus and arrival stations. Sliding door with multiple sensors (15) are positioned at proper distances in order to obtain negative (–) pressure from the air in front of it and positive (+) pressure from the air at the back of it by the space occurred in front of and at the back of the transportation capsule (10) in the cylinder (1) line.

Transfer Systems at the Stations

Figure 18:
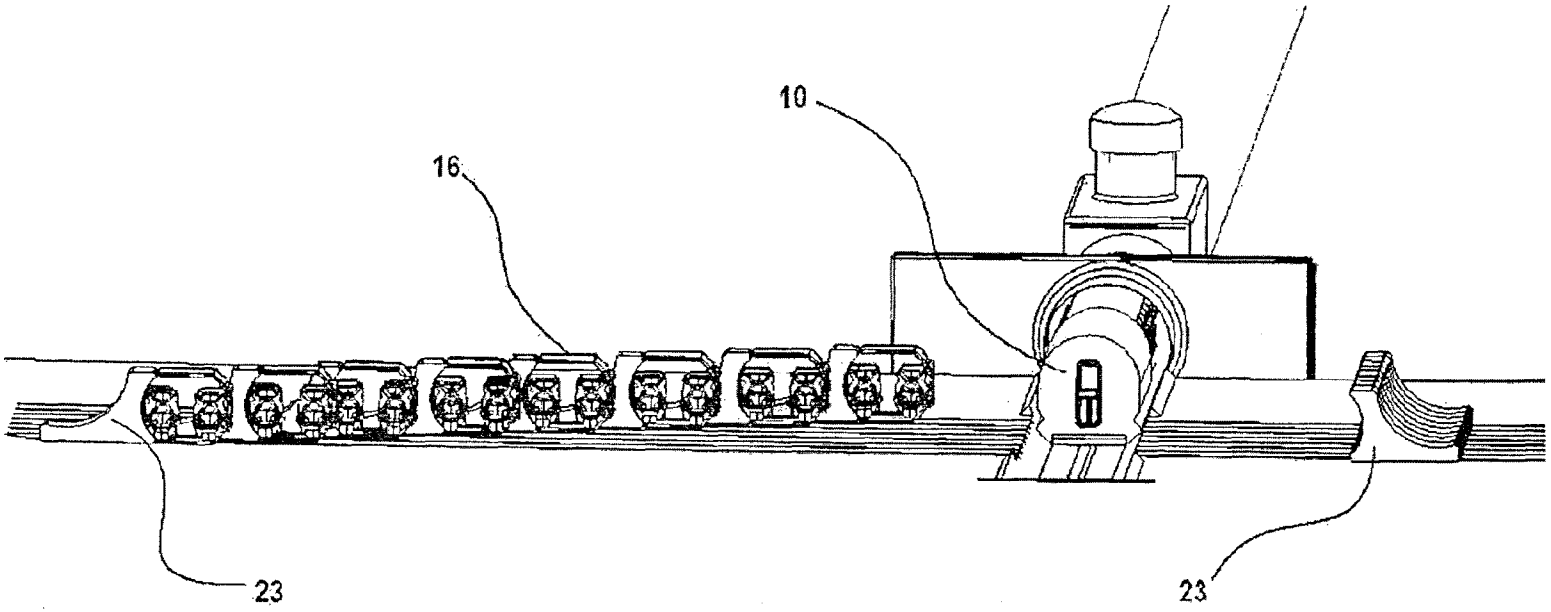

Cabin transfer systems (23) are found at the both sides of the parking place of the transportation capsule (10) at the station. FIG. 18 shows the passenger and cargo carrying cabins (16) taken from the transportation capsule (10) and disembarked to the station. Passenger and cargo carrying cabins (16) which are waiting with passengers seated to passenger seats (26) and fixed with passenger seat belt (27) are placed to the transportation capsule (10) by scale of seconds' determined by cabin transfer systems (23). Factors like the size of the transportation capsule (10); passenger number does not have any effect on this placement duration. Thus whether there are ten passengers or thousand passengers, the duration of the transportation capsule (10) at the station will be stable.

Siding Rescue Stations

Siding rescue stations (24) are placed at proper distances through the cylinder (1) line. When the arrival of the transportation capsule (10) to the station is precluded in exceptional circumstances like earthquakes, sabotage etc., the passengers in the transportation capsule (10) are passed over to the cylinder (1) from the emergency discharge exit (25) and then to the siding rescue station (24).

Passenger and Cargo Carrying Cabins

Passenger and cargo carrying cabins (16) which are positioned into the cabin compartment (31) rail cage system (18) at the cylinder (1), having cabin holder (30) where the cabin transfer system (23) is fixed laterally with passenger seats (26) are designed differently for cargo and passengers. There is a corridor (3) at the middle section for passenger cabins.

Emergency Discharge Exits

Emergency discharge exits (25) are the doors which allows passengers in the transportation capsule (10) to exit into the cylinder (1) when the movement of the transportation capsule (10) to the station is precluded in exceptional circumstances like earthquakes, sabotage etc.

Passenger Seats

Passenger and cargo carrying cabins (16) having passenger seats (26) has the ability to clutch the passengers body from back and sides comfortably by swelling according to the weight of the passenger and automatically wrapping the body of the passenger who is sitting in it during stand by and take-off position. It provides a comfortable and secure travel to the passenger.

Passenger Seat Belts

Passenger seat belt (27) fixes the passenger from four sides to the passenger seat (26) through belt alignment by passing the chest of the passenger from both shoulder levels in a crossed way, in order to limit the motions of the passenger who seats on the passenger seats (26) while the first take-off, stand by and movement of the transportation capsule (10). By this, during the take-off and stand by position, entry—exit of the passenger to the system is maintained in a secure and comfortable way.

Alternative Movement Wheels

Alternative movement wheels (28) are found within the air bag (12) which is beneath the transportation capsule (10) at both ends in a hidden-mounted way. When the air bag (12) can not perform its function properly in other words, when there is a malfunction, alternative movement wheels (28) provides the movement of the transportation capsule (10) through the air bag (12). When there is no movement at the channels based in the station (8), they act as a stabilizer inhibiting the transportation capsule (10) to scatter around. Only the channels based in the station (8) act as a bed and via the capsule puller sledge (29), they pull the transportation capsule (10) to the station or push the transportation capsule (10) into the cylinder (1) while leaving the station.

Capsule Puller Sledge

Capsule puller sledge (29) is an electromechanic equipped mechanism where one of its ends at the station is mounted to the cylinder (1) while its other part is embedded to the ground at the station, performing the movement of the transportation capsule (10) to the station via electro mechanic equipment automatically, at the same time providing the stabilization of the transportation capsule (10) in the station and after the discharge—embarking of the passengers, performing the movement of the transportation capsule (10) into the cylinder (1) again.

Cabin Holder

Cabin holder (30) carries out the function of stabilizing the cabin transfer systems (23) during discharge—embarking by interlocking the passenger and cargo carrying cabins (16) to the transportation capsule (10) by interlocking with cabin transfer systems (23).

Rail Cage System

Rail cage system (18) which is found in the cabin compartment (31) is fixed by being positioned in passenger and cargo carrying cabins (16). Rail cage system (18) is fixed in the transportation capsule (10) and it helps to absorb the momentum effect of the passengers during take-off and stand by moving in the transportation capsule (10) with the effect of the damper equipments (17) which are present at both ends.

Alternative Motor Slide

Alternative motor slide (32), is mounted to the outer side of the cylinder (1) in order to draw air or pump air into the cylinder (1) by opening when it is necessary and also by closing when it is necessary. The alternative motor slide (32) found in the lower part of the alternative motors is an electromechanic system which opens when it is necessary and closes when it is necessary full automatically in order to cut the relationship of the cylinders (1) inner part.

Energy Battery

Energy battery (33) is mounted to the transportation capsule (10) in order to maintain the movement of the transportation capsule (10) from one station to another. It has sufficient power and capacity to be able to meet the energy requirement of some parts like motors and lighting. It is automatically changed with the new battery in every station.

DESCRIPTIONS OF THE DRAWINGS

FIG. 1: The outwardly general view of the cylinder which the capsule moves within.

Figure 2:
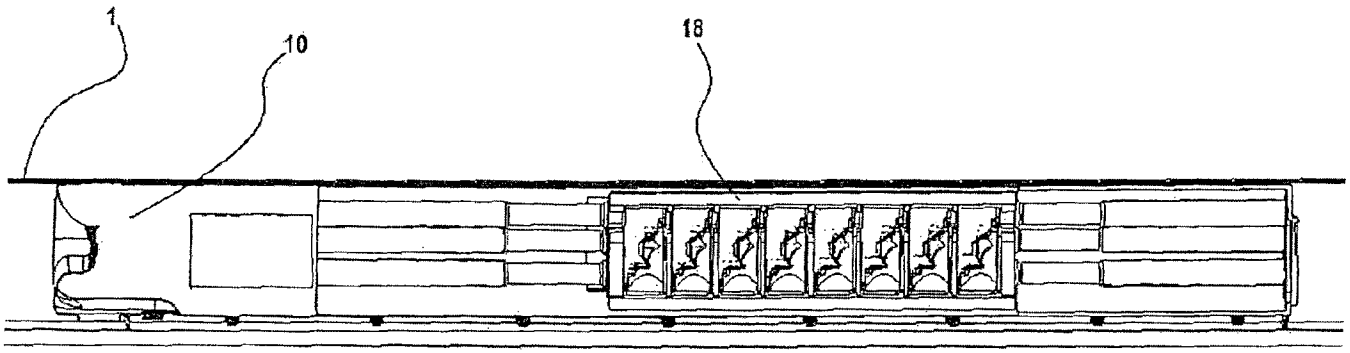

FIG. 2: The lateral sectional view of the cylinders inner side together with the capsule.

Figure 3:
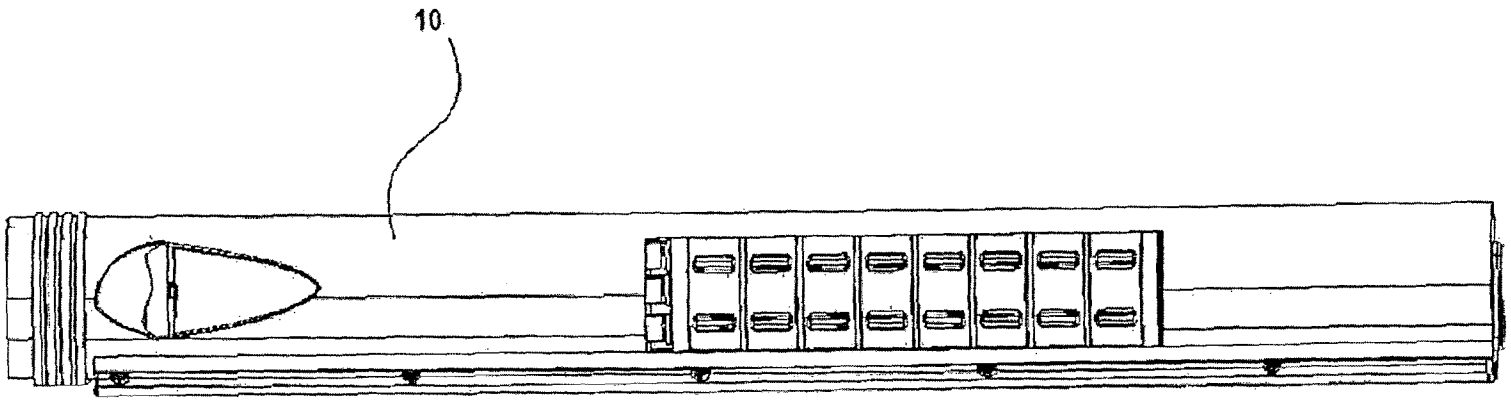

FIG. 3: The lateral view of the capsules external side.

Figure 4:
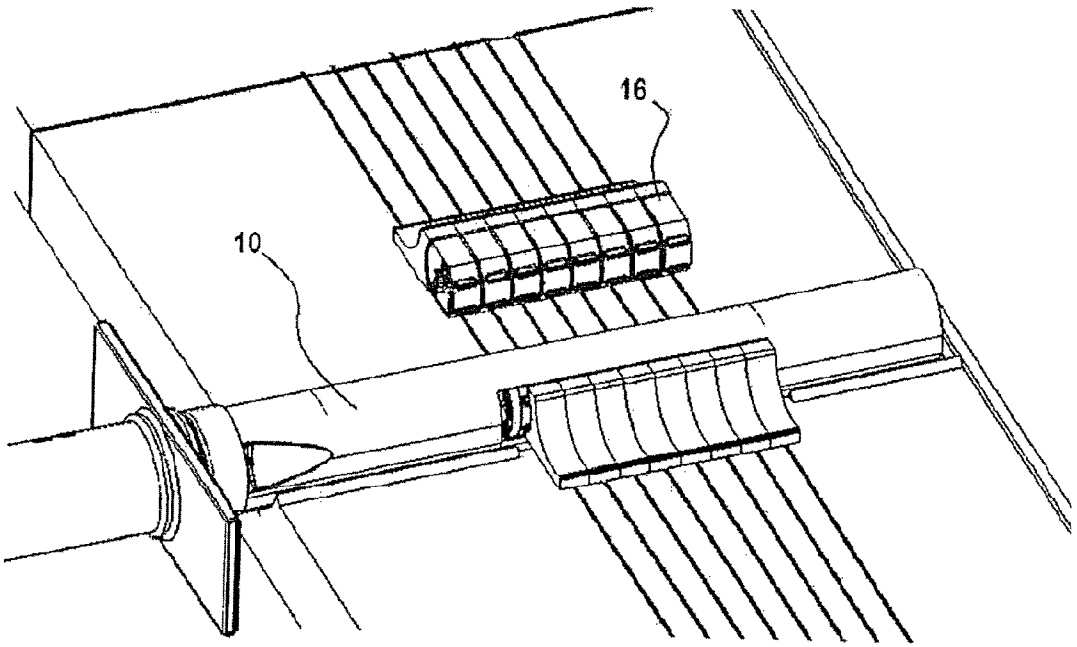

FIG. 4: The perspective view of the cabin loading-discharging process to the capsule at the station.

Figure 5:
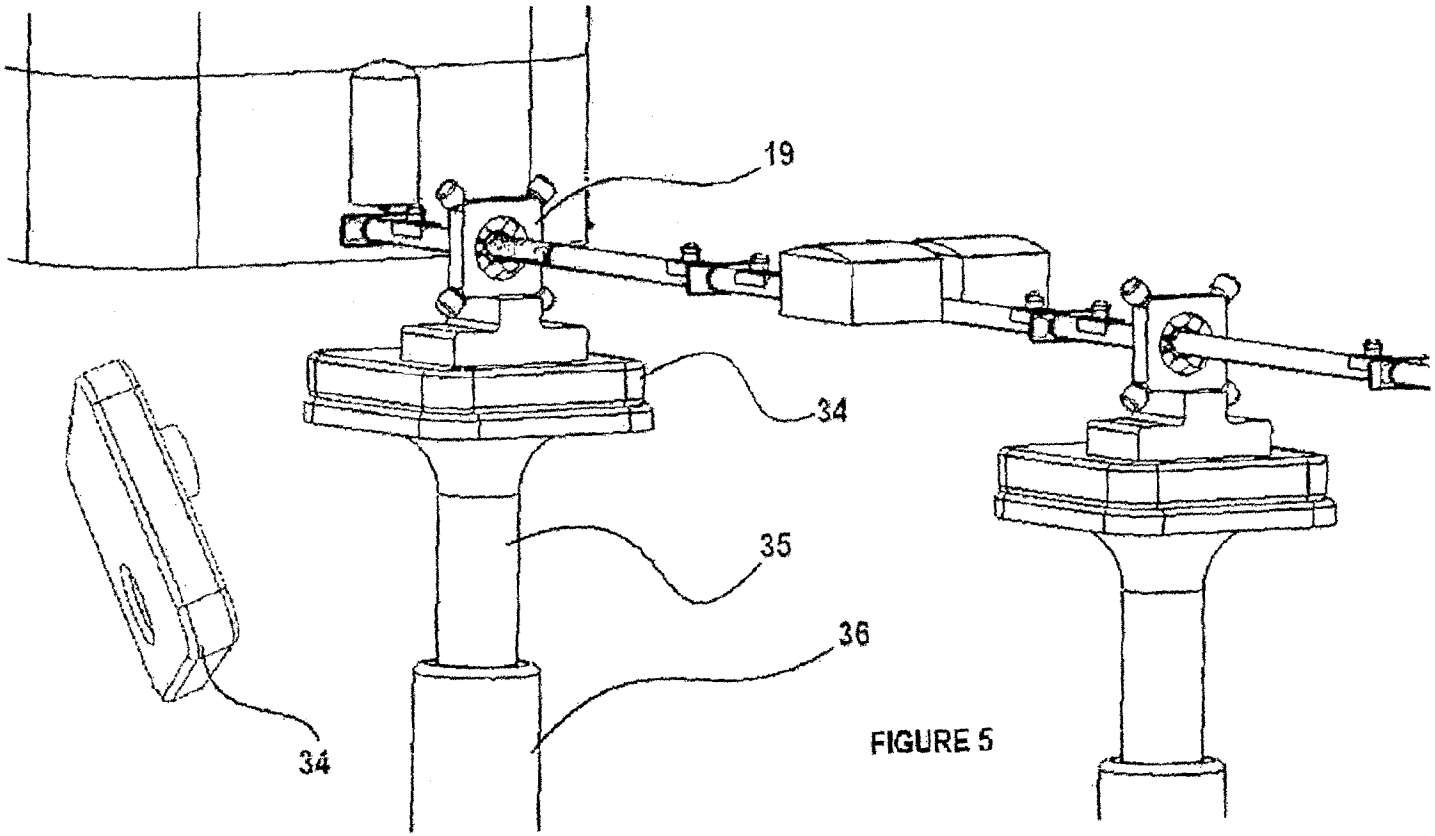

FIG. 5: The isometric view of the electro mechanism equipped cylinder fixing clamps external side.

Figure 6:
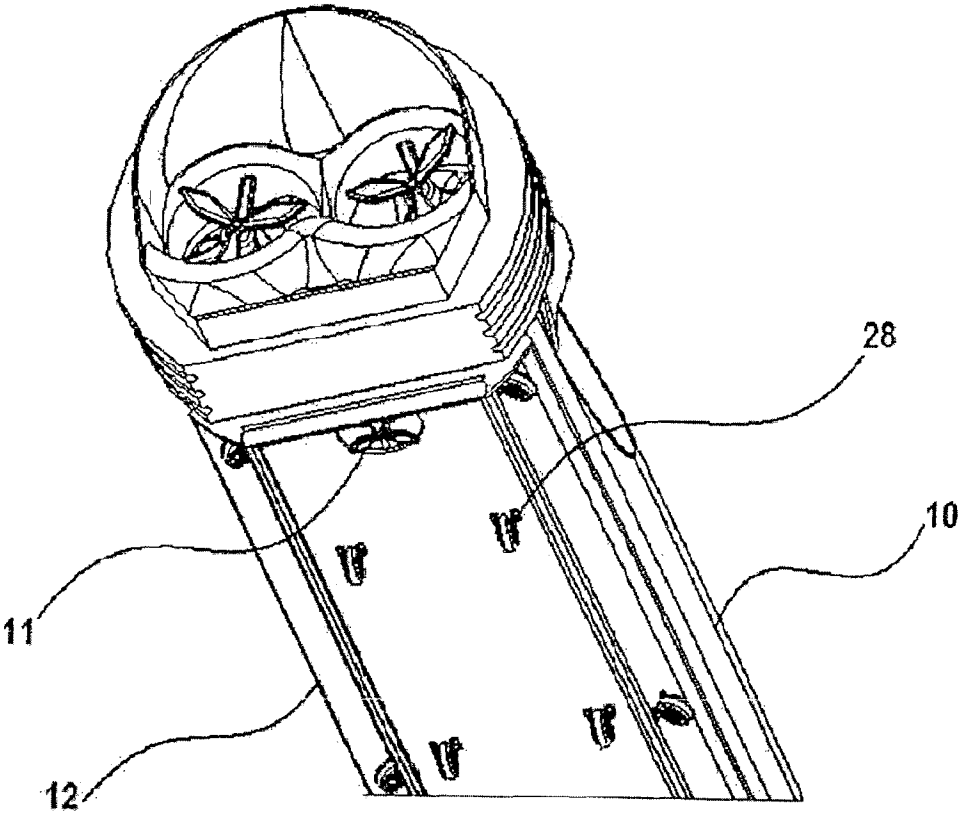

FIG. 6: The view of the capsule together with its lower side, air bags, movement wheels and motored propeller.

Figure 7:
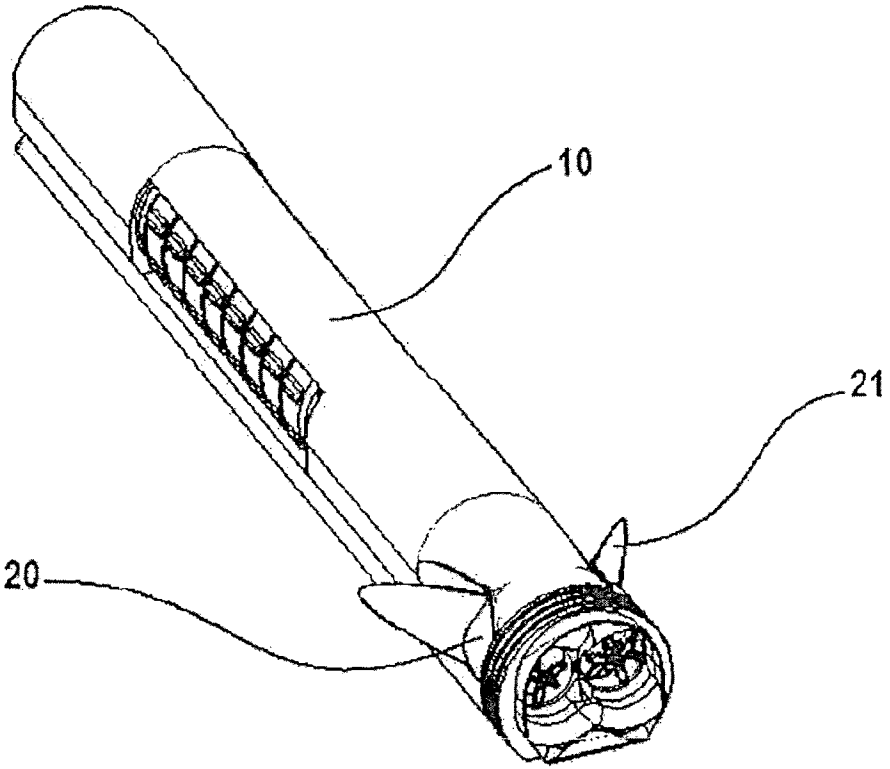

FIG. 7: The opened view of the capsules lower side, air channels and guide of the throttles.

Figure 8:
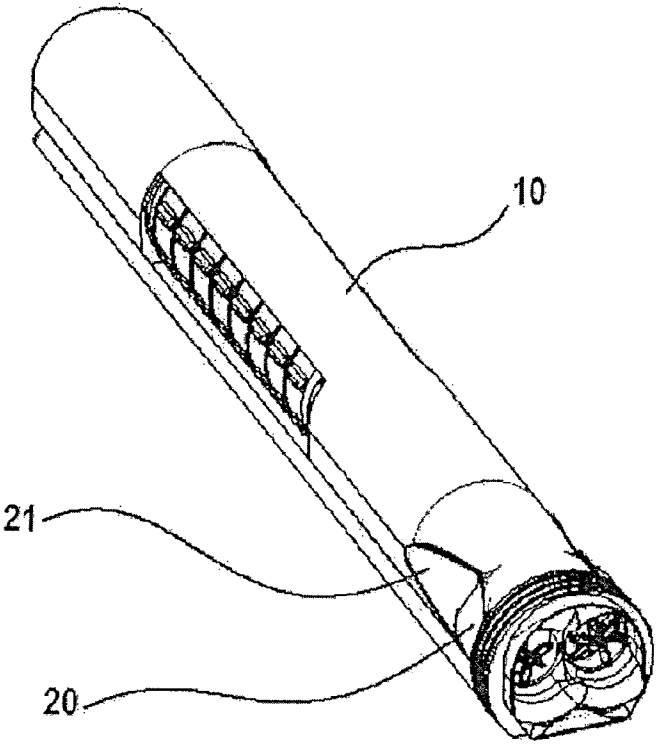

FIG. 8: The closed view capsules upper side, air channels and guide of the throttles.

Figure 9:
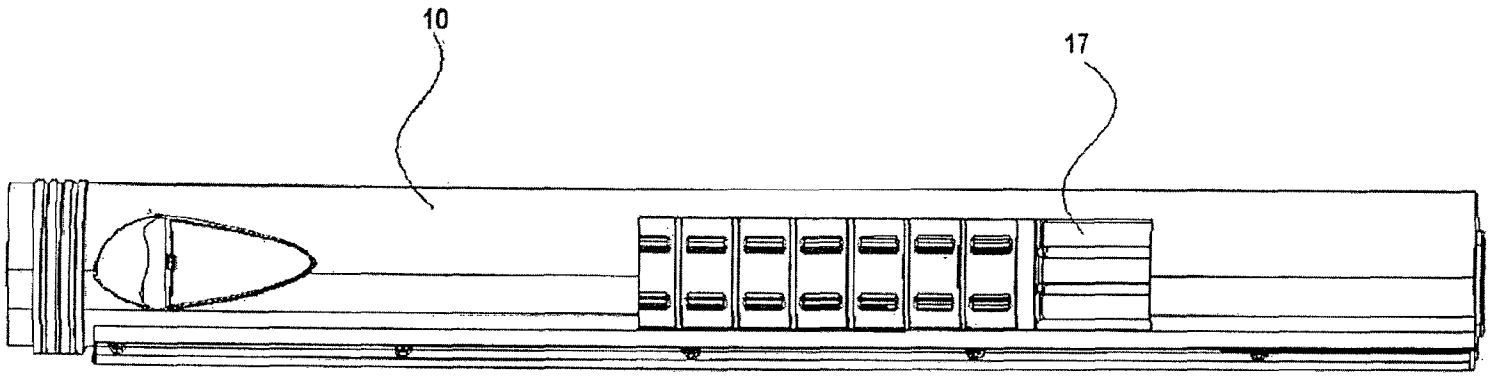

FIG. 9: The closed view of the capsules side dampers front part.

Figure 10:
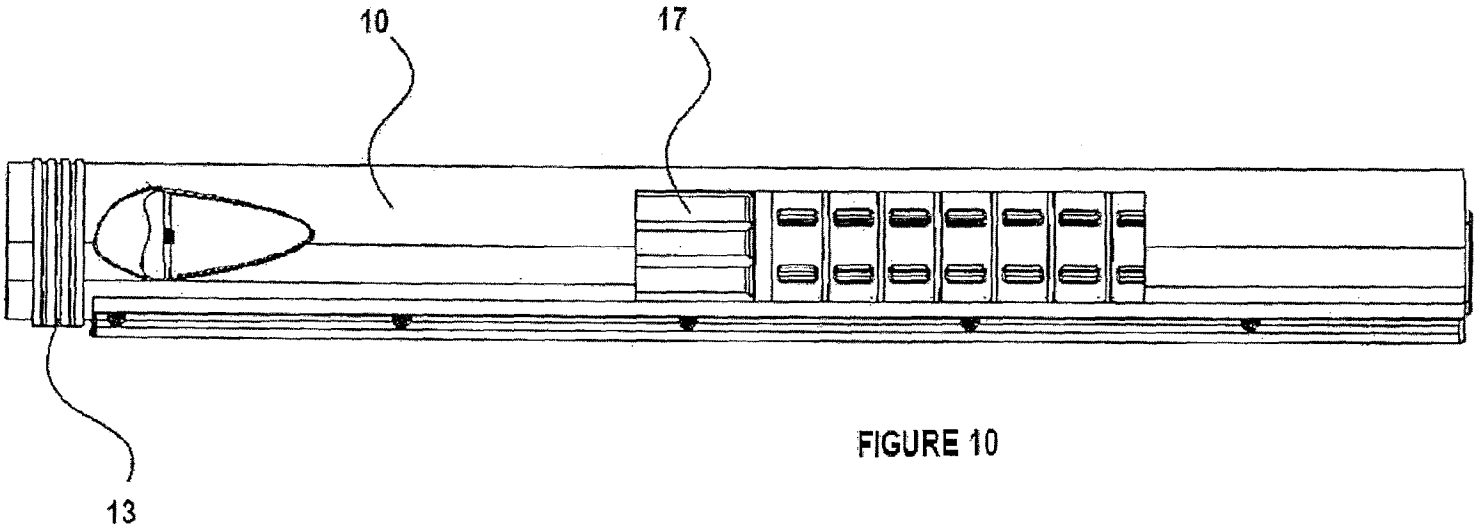

FIG. 10: The closed view of the capsules side dampers back part and the view of the gaskets.

Figure 11:
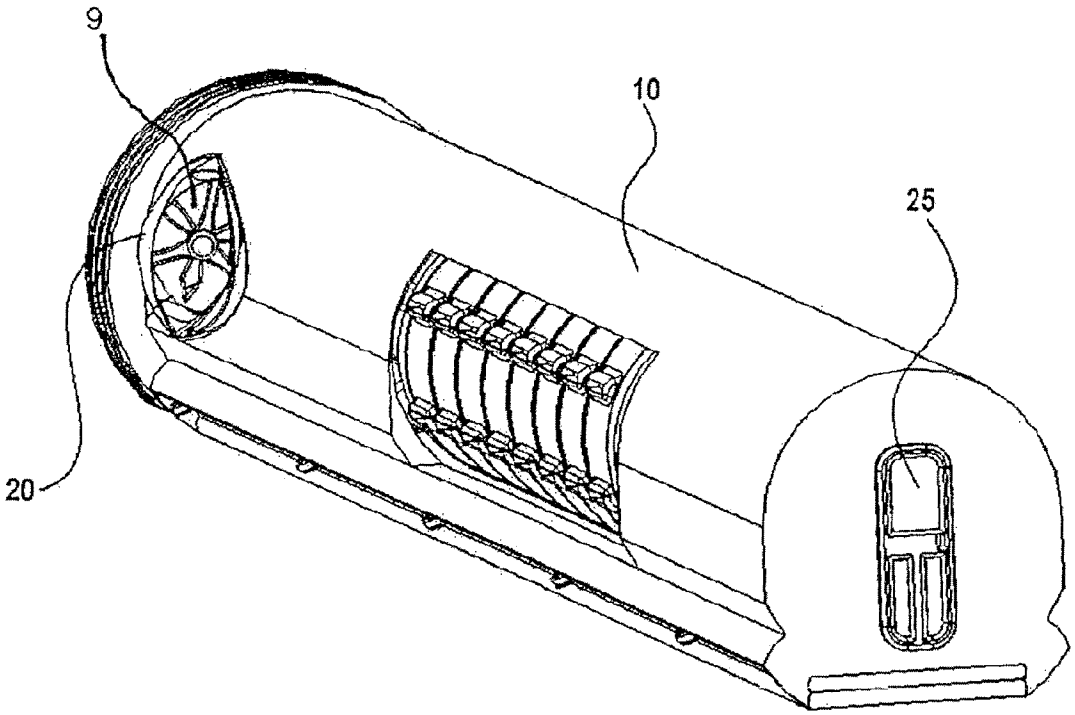

FIG. 11: The view of the capsule from the back side.

Figure 12:
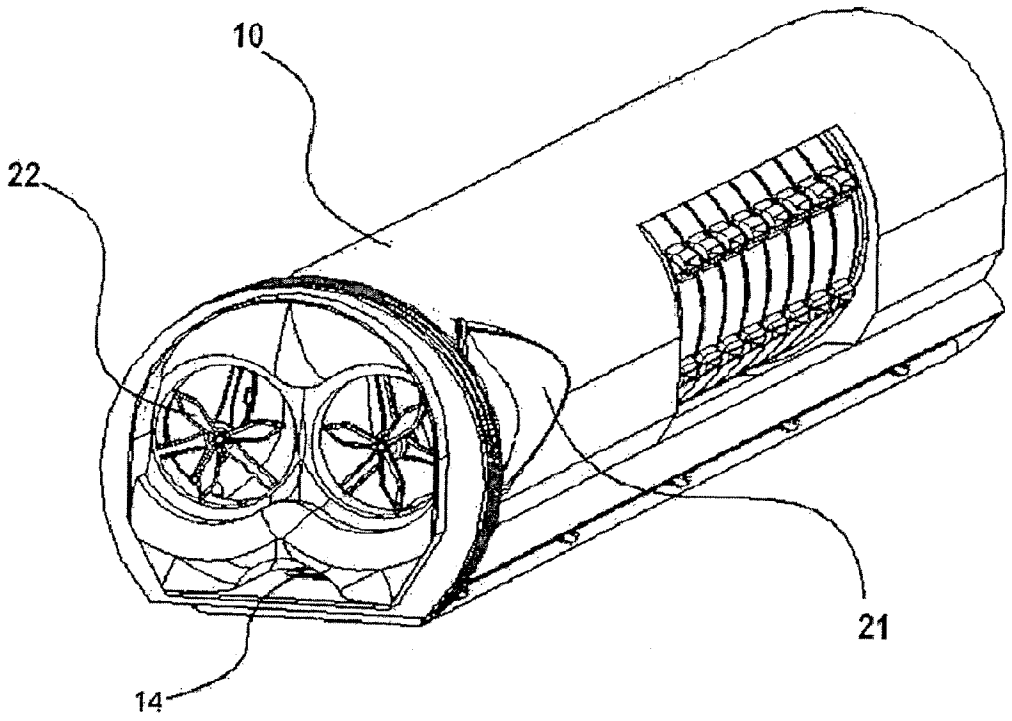

FIG. 12: The isometric view of the capsule from the front.

Figure 13:
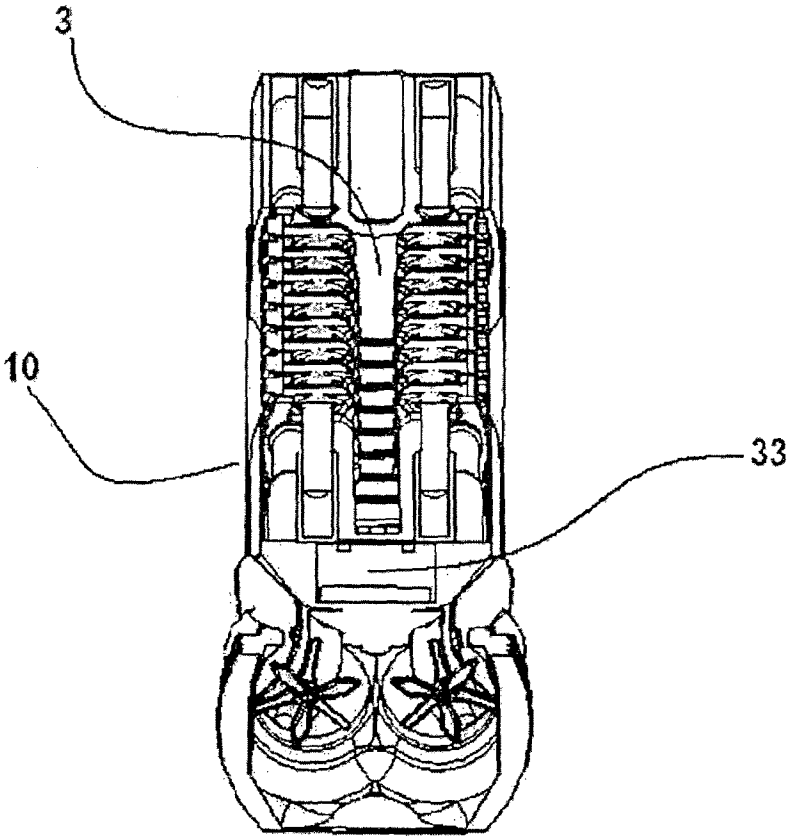

FIG. 13: The sectional view the capsule from the top front.

Figure 14:
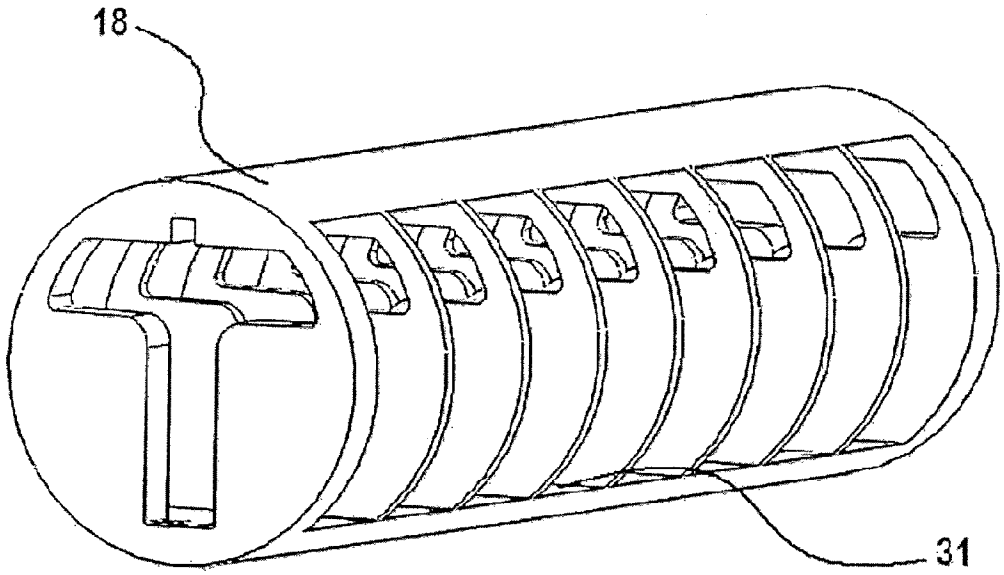

FIG. 14: The view of the rail cage system which is inserted in the capsule.

Figure 15:
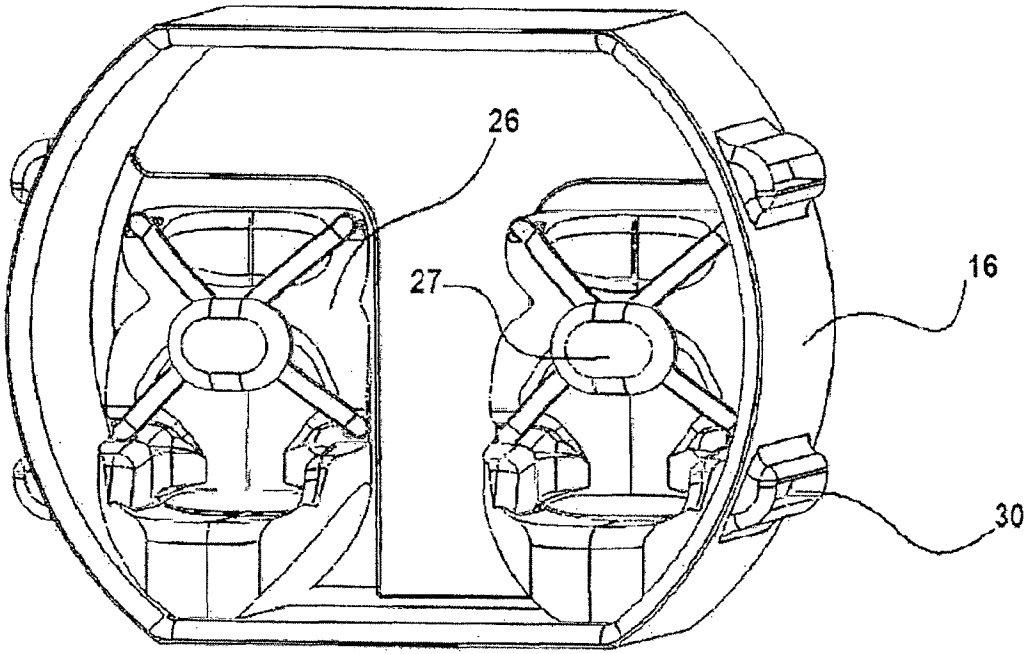

FIG. 15: The front view of the passenger eats within the cabin.

Figure 16:
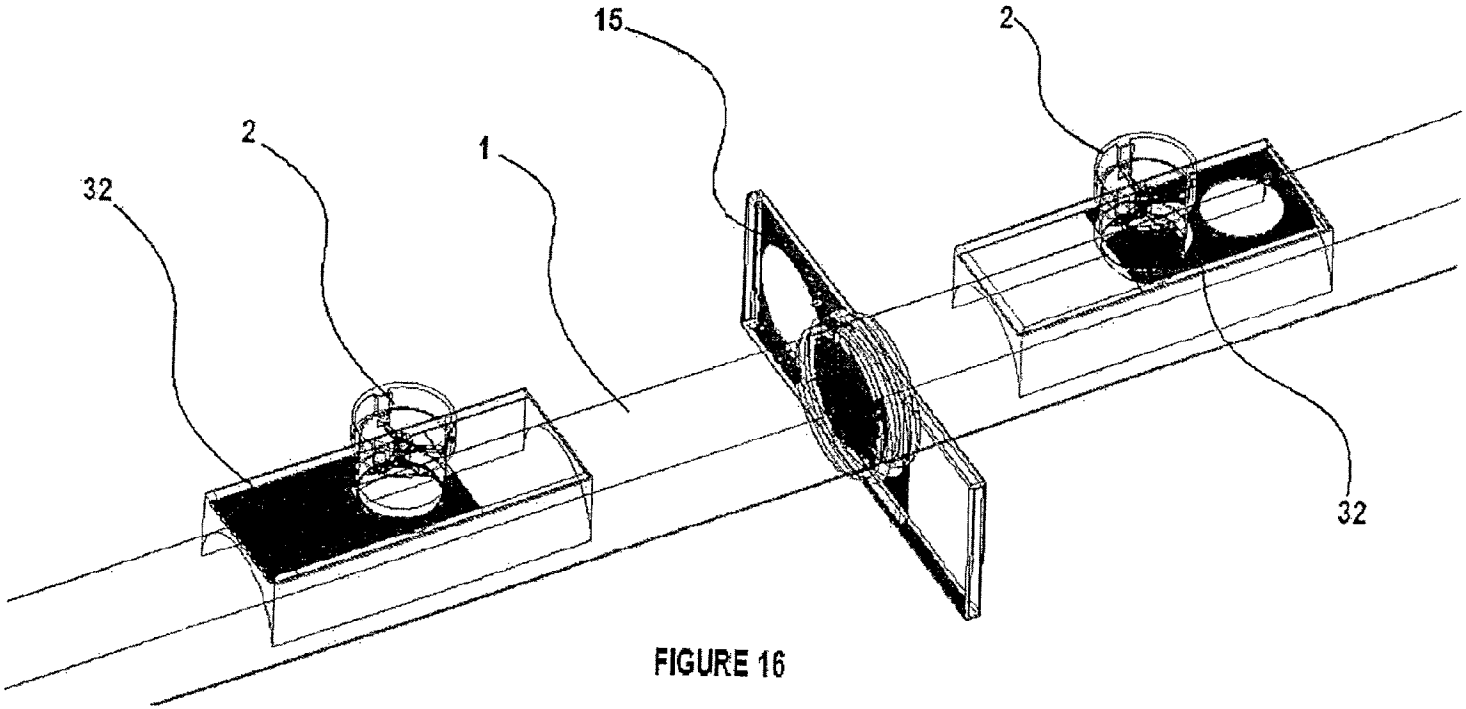

FIG. 16: The closed view of the sliding doors with multiple sensors while the first slide is open and the second slide is closed isometrically at the cylinder line.

Figure 17:
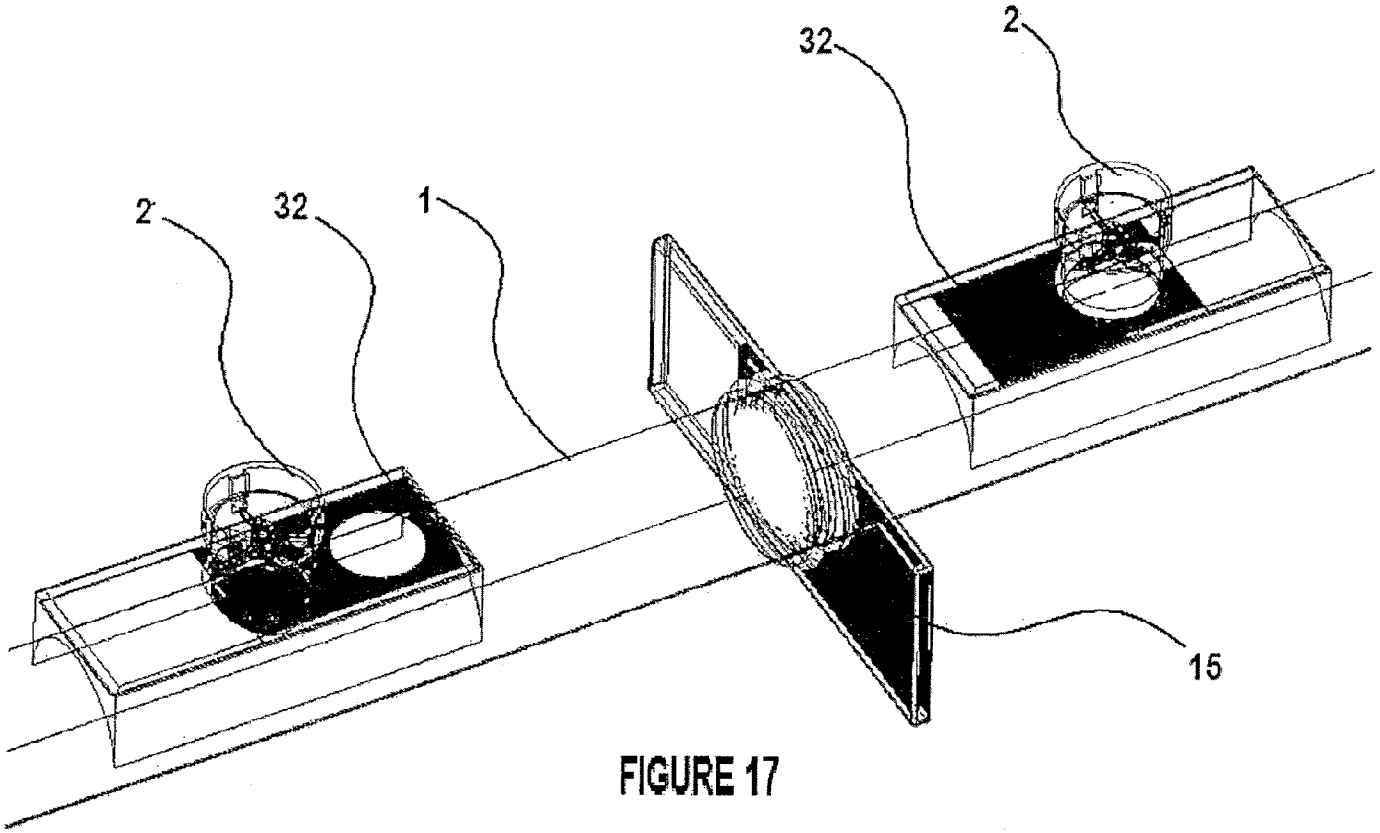

FIG. 17: The opened view of the sliding doors with multiple sensors while the first slide is closed and the second slide is open isometrically at the cylinder line.

FIG. 18: The view of the capsule while entering to the station and passengers are waiting in the cabins connected to the transfer system.

Figure 19:
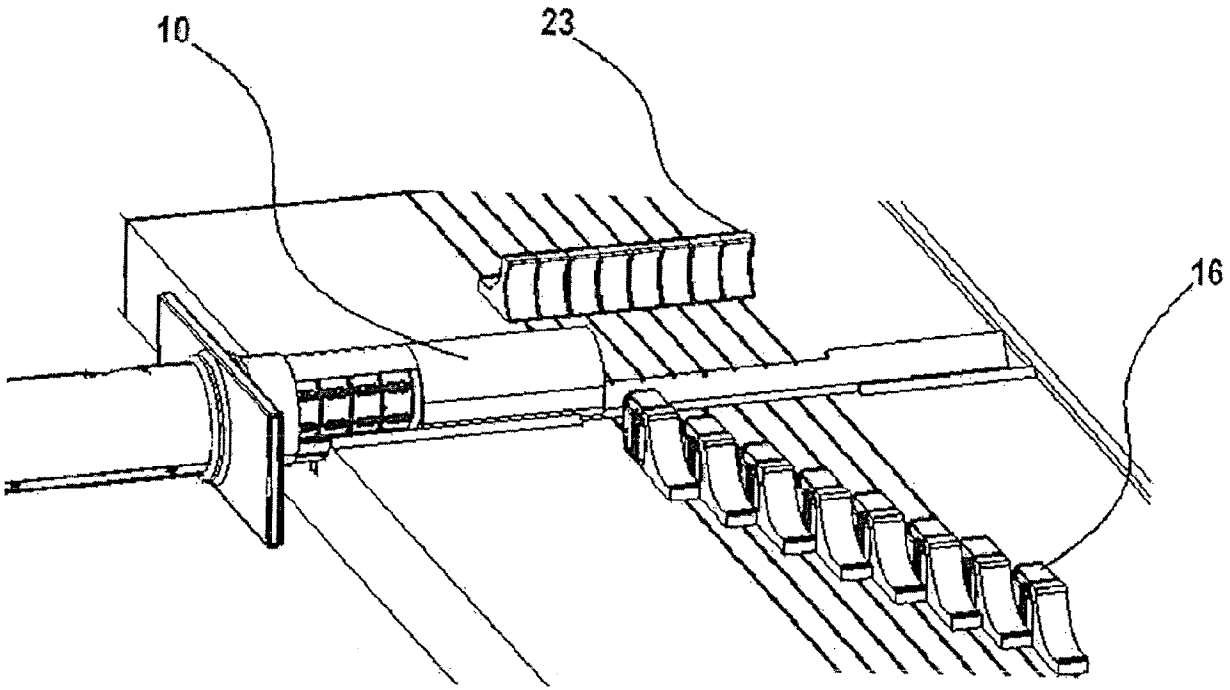

FIG. 19: The view of the capsule while leaving the station and transfer systems in the stations are going back.

Figure 20:
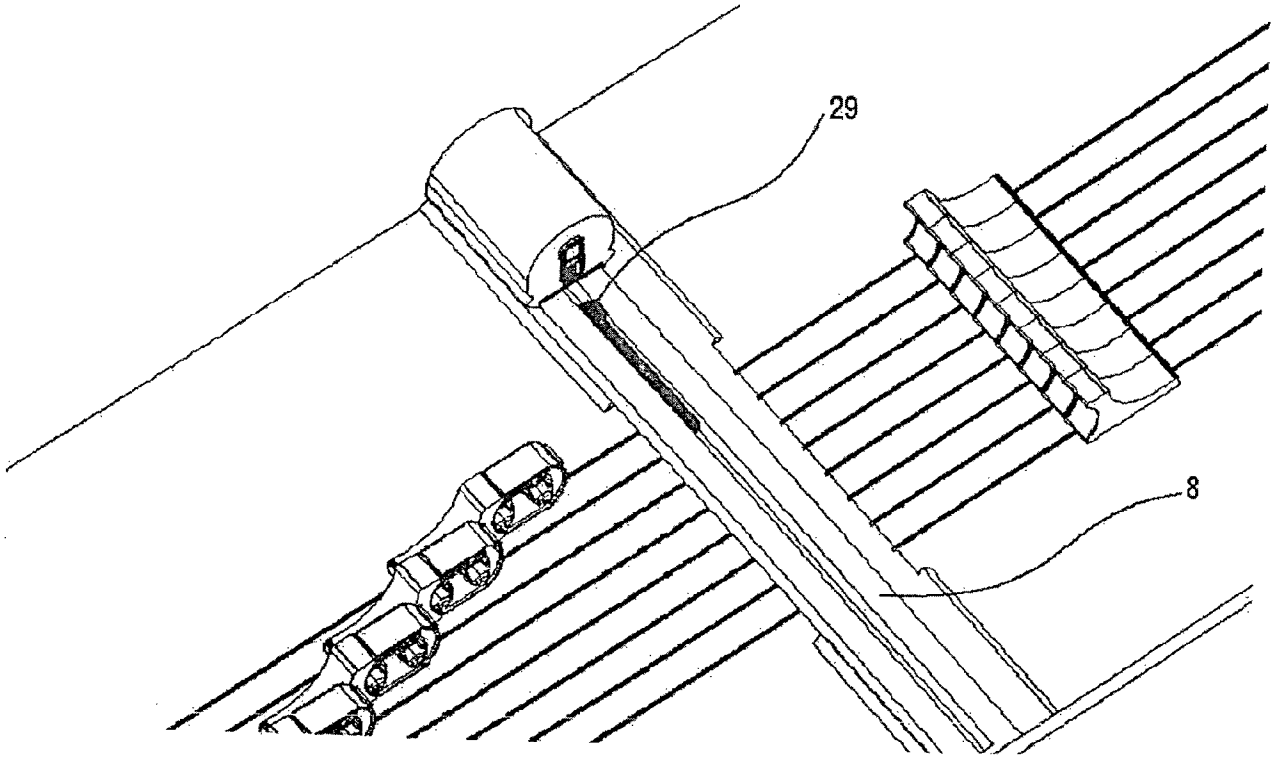

FIG. 20: The view of the capsule within the station while it is pulled by the capsule puller sledge.

Figure 21:
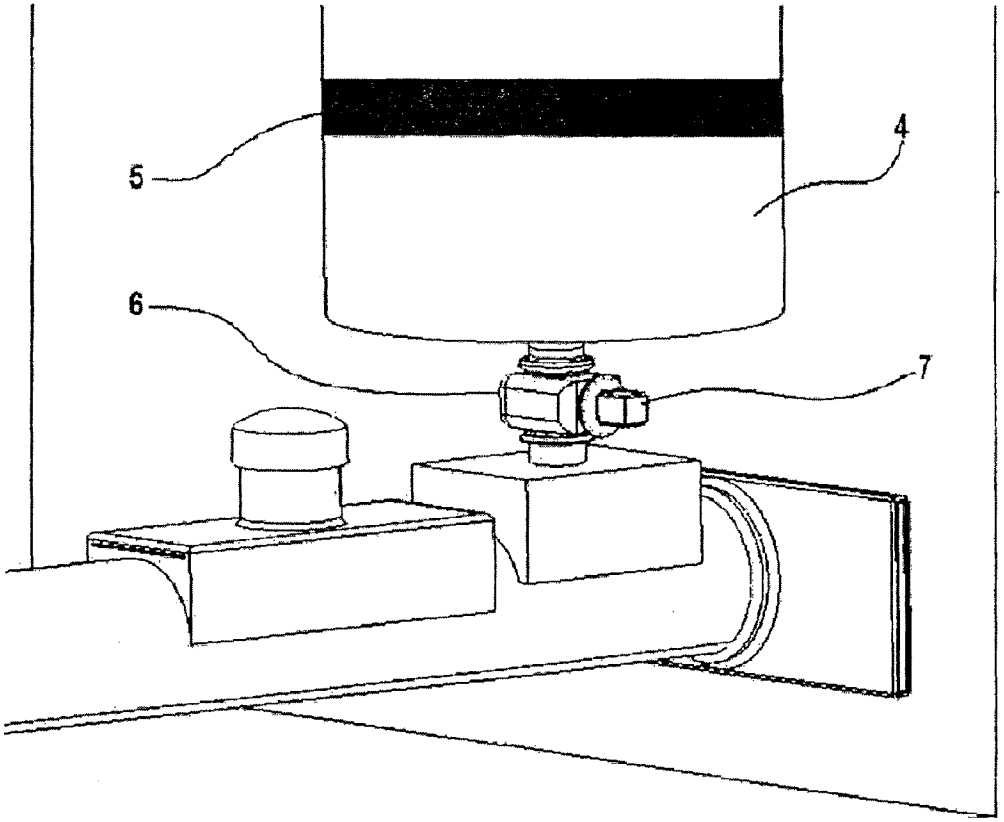

FIG. 21: The view of the electro mechanic mechanical valve, dc motor, reserve depot and piston in the system.

PARTS OF THE SYSTEM

1—Cylinder
2—Alternative air transfer motors
3—Corridor
4—High pressure air reserve depot
5—Heavy mass piston
6—Electromechanic equipped valve
7—Valve motor
8—Channels based in the station
9—Air pass channels
10—Transportation capsule
11—Propeller DC motor
12—Air bag
13—Sealing gasket
14—Inlet air duct
15—Sliding door with multiple sensors
16—Passenger and cargo carrying cabins
17—Damper equipments
18—Rail cage system
19—Cylinder fixing clamp
20—Cap which inhibits the air passage during take-off
21—Air guiding throttle
22—DC motored propellers
23—Cabin transfer systems
24—Siding rescue stations

25—Emergency discharge exit
26—Passenger seat
27—Passenger seat belt
28—Alternative movement wheels
29—Capsule puller sledge
30—Cabin holder
31—Cabin compartment
32—Alternative motor slide
33—Energy battery
34—Eccentric intermediate adaptor
35—Abutment plate piston
36—Abutment cylinder

The invention claimed is:

1. A high speed transportation vehicle system comprising:

a transportation capsule (10) configured to carry passengers and a load inside of the transportation capsule (10);

a cylinder line (1) configured to inhibit external effects of the transportation capsule (10) moving inside the cylinder line (1) between a first station at one end of the cylinder line (1) and a second station at an other end of the cylinder line (1), a high pressure air reserve depot (4) within a heavy mass piston (5) at each end of the cylinder line (1), wherein the air reserve depot (4) comprises a sealing gasket, friction parts covered with a slick material and an inner surface covered with the slick material, wherein the high pressure air reserve depot (4) is configured to recover energy from braking of the transportation capsule (10) to replace energy consumed during an initial take off of transportation capsule (10) from one of the first station or the second station, one or more alternative air transfer motors (2) disposed along the cylinder line (1) between the first station and the second station, the one or more alternative air transfer motors (2) comprising movable wings that are positioned on an outer side of a body of the cylinder line, the one or more alternative air transfer motors (2) configured to pump air through an opening in the cylinder line (1) to support the movement of transportation capsule (10) and withdraw air from the cylinder line (1) through the opening, and one or more sliding doors with multiple sensors (15) disposed along the cylinder line (1) between the first station and the second station and between the alternative air transfer motors (2), the one or more sliding doors configured to slide to a closed position to close the cylinder line (1) to obtain a negative (−) pressure from the air in front of the transportation capsule (10) as it is moving and obtain a positive (+) pressure from the air at the back of the transportation capsule (10);

air guiding throttles (21) disposed along one or more sides of the transportation capsule (10), the air guiding throttles (21) being configured to transmit air pressurized by a DC motor propeller (22) positioned on a head part of transportation capsule (10) to an inner surface of the cylinder line (1);

passenger and cargo carrying cabins (16) disposed with the transportation capsule (10), the cabins (16)

one or more cabin holders (30) disposed on an exterior surface of the cabins (16) configured to interlock the cabins (16) to the transportation capsule (10);

cabinet transfer systems (23) found at both sides of parking place of the transportation capsule (10) at the first station and the second station, the cabinet transfer systems (23) configured to pass the passenger and cargo carrying cabins (16) to and from the transportation capsule (10);

a capsule puller sledge (29) at one or more of the first station and the second station, one end of the capsule puller sledge (29) mounted to the cylinder line (1) and an other end embedded in a ground portion of the one or more first station and second station, the capsule puller sledge (29) comprising an electro mechanic equipped mechanism configured to move the transportation capsule (10) to the first station or second station automatically and stabilize the transportation capsule (10) in the first station or second station;

a cylinder fixing clamp (19) configured to secure the cylinder line (1) to a line fixed to the ground, the line to the ground including an abutment cylinder (36), plate piston (35) and eccentric medium adapter (34), the line being controlled by one or more GPS satellite systems and sensors mounted along the line and configured to regulate a position of the cylinder fixing clamp (19) relative to geologic alterations; and a rail cage system (18) disposed in the transportation capsule (10), the rail cage system (18) being fixed to damper equipment (17) at both ends of the transportation capsule (10), the rail cage system (18) being configured to transmit the momentum effect during take- off and stand by of the transportation capsule (10) to this damper equipment (17).

2. The system according to claim 1, wherein the high speed transportation vehicle and system further comprises air pass channels (9) on both sides of the head part of the transportation capsule (10), the air pass channels having a cap (20) which inhibits air passage during take-off.

3. The system according to claim 1, wherein the high speed transportation vehicle and system further comprises an alternative motor slide (32) mounted to the outer side of the cylinder line (1) under a part of the alternative air transfer motor (2) that is mounted to the outer side of the cylinder line (1) in order to draw air inside of the cylinder line (1) or to provide air transfer inside of cylinder line (1) by opening or closing the alternative motor slide (32) when necessary.

4. The system according to claim 1, wherein the high speed transportation vehicle and system further comprises alternative movement wheels (28) disposed within an air bag (12) beneath the transportation capsule (10) at both ends of the transportation capsule (10), the alternative movement wheels (28) configured to provide movement of the transportation capsule (10) when there is a malfunction of the air bag (12).

5. The system according to claim 1, wherein the high speed transportation vehicle and system further comprises passenger seats (26) disposed in the cabins (16), the passenger seats (26) configured to clutch a passengers body comfortably and securely by swelling according to the weight of the passenger who is sitting in it.

6. The system according to claim 5, wherein the high speed transportation vehicle and system comprises a passenger seat belt (27) that fixes the passenger from four sides to the passenger seat (26) through belt alignment by passing the chest of the passenger from both shoulder levels in a crossed way.

7. The system according to claim 1, wherein the high speed transportation vehicle and system further comprises emergency discharge exits (25) configured to allow passengers in the transportation capsule (10) to exit into the cylinder line (1).

8. The system according to claim 7 wherein the high speed transportation vehicle and system comprises siding rescue stations (24) disposed along the cylinder line (1), the siding rescue stations (24) configured to enable passengers to pass over to the cylinder line (1) from the emergency discharge exit (25).

9. The system according to claim 1, wherein the high speed transportation vehicle and system further comprises an energy battery (33) mounted to the transportation capsule (10), the energy battery configured to provide sufficient power and capacity to meet the energy requirement of the transportation capsule (10).

10. The system according to claim 1, wherein the high speed transportation vehicle and system wherein the eccentric medium adapter (34) is configured to rotate 360 degrees and is configured to absorb lateral effects on the cylinder line (1) by geological circumstances and keep the cylinder line (1) in a fixed position.

11. The system according to claim 1, wherein the high speed transportation vehicle and system wherein the abutment plate piston (35) is configured to absorb perpendicular and vertical effects on the cylinder line by geological circumstances.

12. The system according to claim 1, wherein the high speed transportation vehicle and system wherein the abutment cylinder (36) is connected to the ground and configured to rise to different heights and supports the cylinder line (1) on a predefined plane.

* * * * *